United States Patent [19]

Massimo et al.

[11] Patent Number: 4,658,576

[45] Date of Patent: Apr. 21, 1987

[54] DEVICE FOR THE PARALLEL AUTOMATIC FEEDING OF ORNAMENTAL CHAINS, IN PARTICULAR FOR THE PRODUCTION OF PAIRED CHAINS

[75] Inventors: Bucefari Massimo; Roberto Rubechini, both of Arezzo, Italy

[73] Assignees: I.C.M. S.p.A. Italiana Costruzioni Metal Meccaniche; T.E.M. s.r.l. Technologie Eletroniche e Meccaniche, both of Arezzo, Italy

[21] Appl. No.: 717,975

[22] Filed: Mar. 29, 1985

[30] Foreign Application Priority Data

Mar. 29, 1984 [IT] Italy ..... 9365 A/84

[51] Int. Cl.[4] ..... B21K 15/02

[52] U.S. Cl. ..... 59/34; 59/16; 59/31; 226/62; 226/67

[58] Field of Search ..... 59/16, 24, 31, 32, 26, 59/7, 34; 226/62, 67, 60

[56] References Cited

U.S. PATENT DOCUMENTS 1,833,444 11/1931 Stuller ..... 59/31

2,772,325 11/1956 Gaite ..... 226/62

3,028,723 4/1962 Kaplan et al. ..... 59/7

3,701,253 10/1972 Wust ..... 59/31

FOREIGN PATENT DOCUMENTS 513536 2/1955 Italy ..... 226/67

*Primary Examiner*—R. L. Spruill

*Assistant Examiner*—David B. Jones

*Attorney, Agent, or Firm*—Browdy and Neimark

[57] ABSTRACT

A device for feeding in parallel of ornamental chains to an operative unit of a machine suitable for realizing the bonding of the chains, including a mechanism for the transport of the chains towards the operative unit arranged for the engagement with side by side links of the chains and for obtaining the simultaneous and intermittent advancement without modifying the symmetry of their reciprocal position with respect to the advancement axis. The transport mechanism, comprising in particular needle-shaped members, are provided with a reciprocating translational motion in the forward direction and a reciprocating lifting and lowering motion in an orthogonal direction.

7 Claims, 2 Drawing Figures

DEVICE FOR THE PARALLEL AUTOMATIC FEEDING OF ORNAMENTAL CHAINS, IN PARTICULAR FOR THE PRODUCTION OF PAIRED CHAINS

The present invention has as an object a device for the automatic parallel feeding of ornamental chains, in particular for the production of paired chains.

In the goldsmith industry, as it is known, the term paired chain means a chain, obtained starting from two or more chains suitably welded to each other in the contact point of the side by side links, the starting chains being fed in parallel side by side to the welding unit. A typical example of paired chain is the so-called "Bismarck" chain obtained from the pairing, in the above mentioned meaning, of two chains of the "forzatina" type, i.e. of the kind constituted of planar annular links connected the one to the other in a regular sequence.

The paired chains are presently made with almost exclusively hand processes.

In the realization of an automatic device for the feeding of chains destined to be paired, the most important problem to be resolved consists essentially in the fact that, besides having to cope with the simultaneous and intermittent advancement of the chains, one should provide that the side by side links to be welded together be absolutely symmetrical each other with respect to the median axis of the paired chain that, substantially, coincides with the advancement axis or direction. Clearly a paired chain where the side by side links of the starting chains are offset, even slightly, each other, would be aesthetically unacceptable.

As a matter of fact, with a simple measurement of equal lenghts of chains to be simultaneously fed, in general it is not possible to fulfil such condition, both because the links of a chain may show slight dimensional differences, and cosequently to equal lengths of chain an asymmetrical advancement of side by side links may correspond, and because the known devices for realising this operation, apart from their high cost, do not guarantee the complete absence of slipping of the chains during their advancement and definitely do not assure the constance, within the required precision limits, of the length of the fed portions of chain.

According to the present invention, a device is provided for feeding two or more ornamental chains to an operative unit of a machine for the preparation of a chain resulting from the combination of the starting chains, a device that provides for the simultaneous and intermittent advancement, according to a predetermined time sequence, of portions of the chains in which the side by side links therein contained result constantly symmetrical with respect to the advancement axis.

The basic characteristic of the device consists indeed in that for the transport of the chains, located within suitable run guides, means is provided for the transport of the chains that exploiting the geometrical pattern of the same, is suitable for the engagement with side by side links of the same and is provided with a translational reciprocating motion, to and fro, in the advancement direction, and a lifting and lowering reciprocating motion in a direction orthogonal to the advancement direction, this lifting motion being provided at the end of the forward stroke of the translational motion towards the operative unit, for allowing the disengagement from the links after the advancement of desired portions of chains, the lowering motion being provided at the end of the return stroke of the translational motion, for allowing the engagement of the transport means with new corresponding the by side links. In particular, said transport means is constituted in the simplest and preferred embodiment, of a head, provided with the above movements, carrying needle shaped members in a number equal to the members of the fed chains, orthogonal to the advancement direction thereof, and located at a reciprocal distance that is related to the dimensions of the fed chains. In this way, since the reciprocal position of the needle shaped members is fixed, these, for transporting forward the chains, carry each time, perfectly aligned with each other the forward ends of the links in which they are respectively engaged, thus compensating, continuously, possible slight dimensional differences of the links and assuring the constant symmetry of the pairing of the same.

The features, as well as the advantages, of the device according to the present invention will appear more clearly from the description of an embodiment thereof, referred to as a non-limitative example, and made with reference to the attached drawings, wherein.

Figure 1:
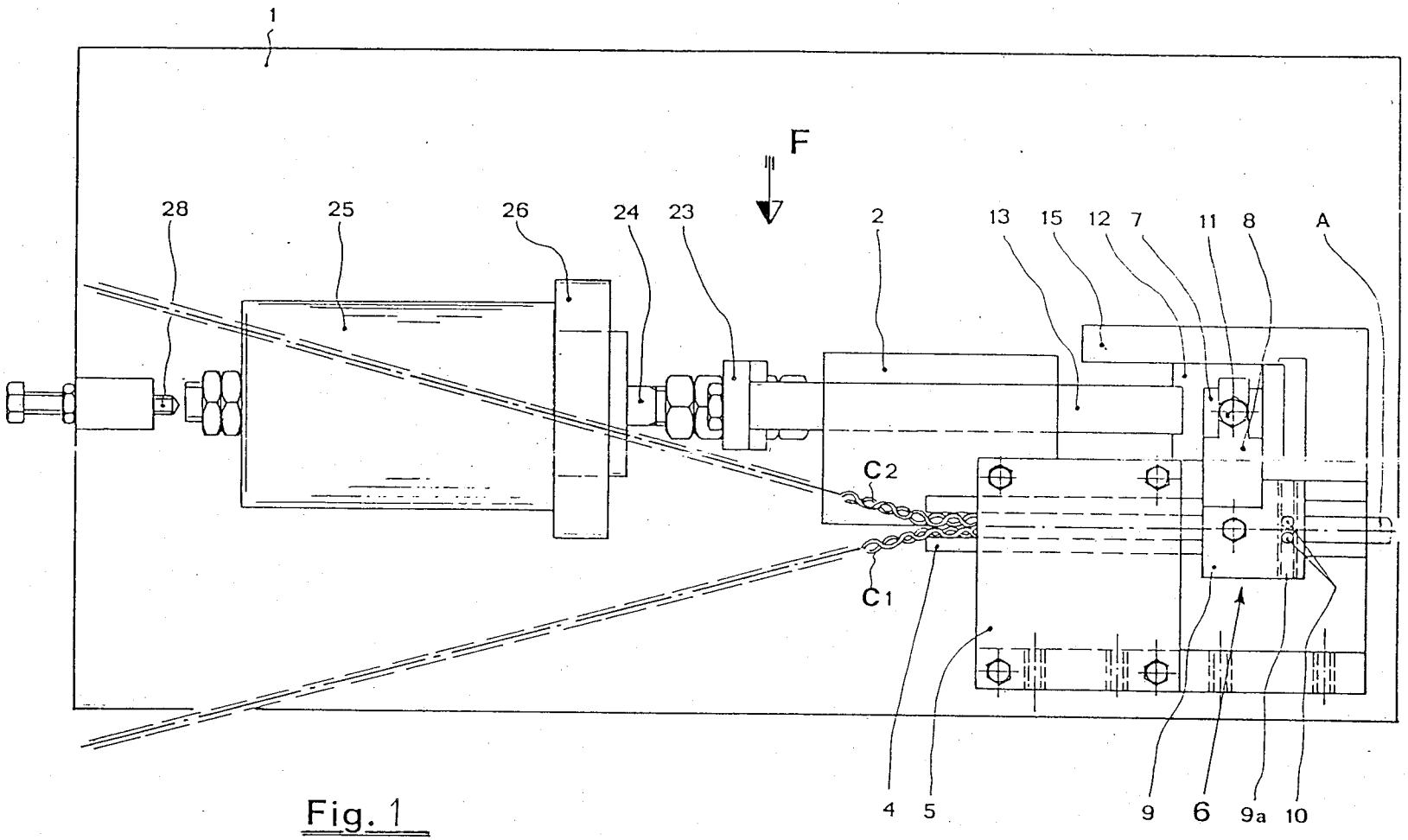
FIG. 1 is a top plan view of the device according to the invention.
Figure 2:
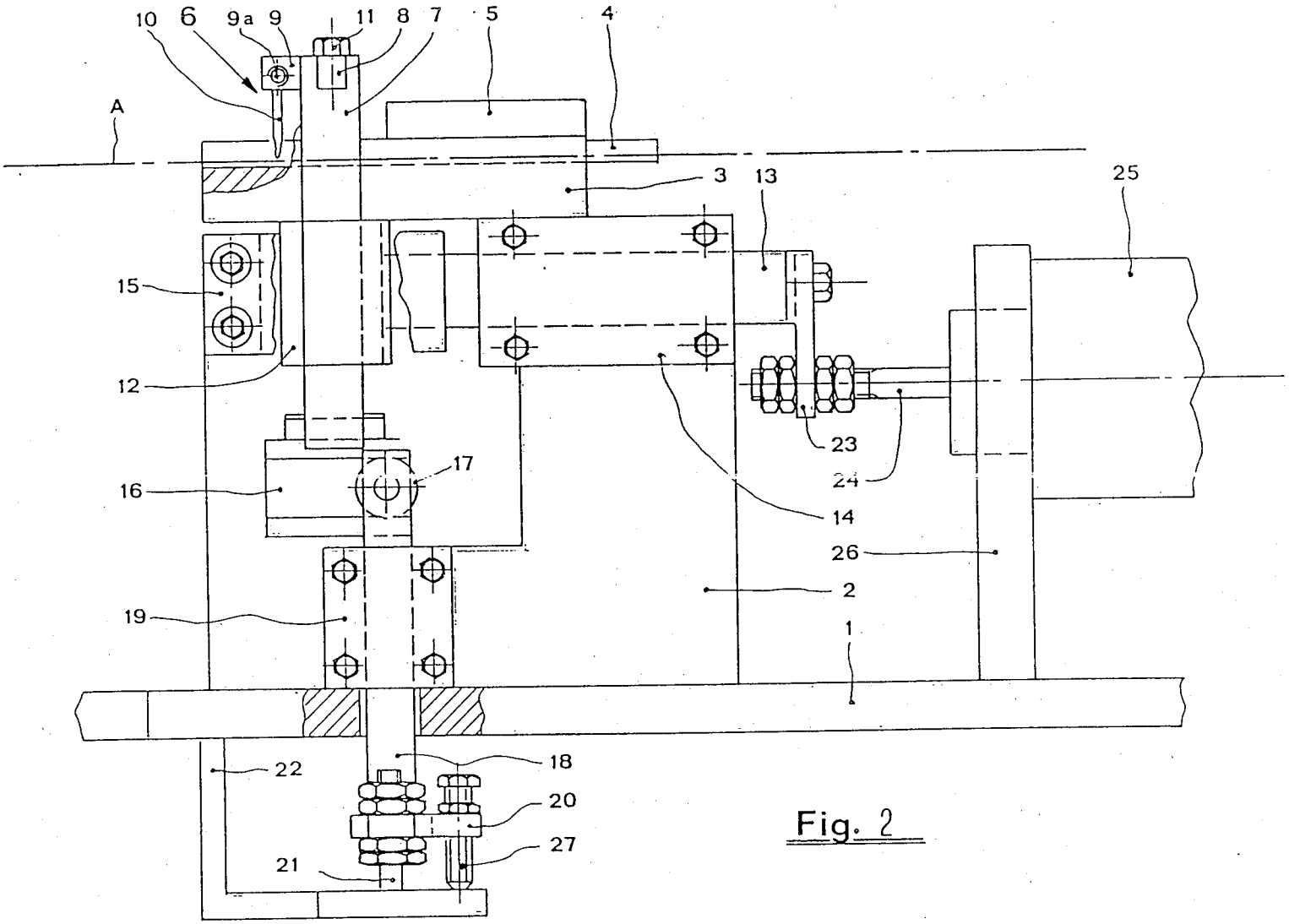
FIG. 2 is an enlarged lateral elevational view according to the arrow F of the device shown in FIG. 1.

With reference to FIGS. 1 and 2, there is shown at 1 an horizontal base plane, whereon the device according to the invention is mounted. On the plane 1 there is fixed a support base 2 whereon a housing base 3, is mounted, for a guideway 4 for two chains indicated by C1 and C2, coming from two separate braked coils of the conventional type and not shown. In the guideway 4 the chains C1 and C2 are placed side by side and aligned according to the advancement direction indicated with the dashed and dotted line A. The guideway 4 is blocked onto its housing base 3 by means of a top plate 5. The base 2 operates as a support also for transport means for the chain C1 and C2 generally shown at 6 and located register with the exit end of the guideway 4. The transport means includes substantially a vertical slide 7, extending laterally to the guideway 4 and in proximity of the end for the exit of the chains; on the top end of the slide 7 there is fastened in an adjustable way a horizontal arm 8 extending up to and above the guideway 4 and carrying in register therewith a head 9 whereon two sharpened pins 10 are fixed, by means of a suitable transversal pin 9*a*, laying on a vertical plane orthogonal to the advancement direction A of the chains C1 and C2 and directed towards the guideway 4 with their sharpened ends. The dimensions of the sharpened pins 10 are such as to allow the engagement of each of them with a link of the underlying chain C1 or C2. In order to adjust the position of the sharpened pins 10 with respect to the guideway 4, the arm 8 may be made to slide laterally with respect to the slide 7 and may be locked into the desired position by means of a screw 11.

The slide 7 is slidingly mounted within a corresponding movable vertical guideway 12, that is fastened to the end of a horizontal slide 13 slidable on its turn within a guideway provided for this purpose and fastened to the base 2 of the device. The movable guideway 12 of the slide 7 is placed in sliding contact with two opposed and ground walls of the base 2 and with a square plate 15 fastened to the base 2. At the lower end of the guideway 7 there is fastened a horizontal tubular guideway 16 within which a small roller 17 is slidingly engaged, that is placed at the end of a further slide 18, slidable within a fixed vertical guideway 19, and connected by means of an arm 20 to the plunger 21 of a not-shown electromagnet, located under the base plane 1 of the device and supported by it by means of a bracket 22. The horizontal slider 13 is further connected by means of an arm 23 to the plunger 24 of an electromagnet 25 fastened to the base plane 1 by means of a support 26.

Through the above described connections the transport means 6 of the chains is provided with a double reciprocating motion: the first one in a horizontal sense, i.e. in the advancement direction A of the chains, controlled by the electromagnet 25 which causes the horizontal sliding motion of the slide 13 of the movable guideway 12 making the vertical slide 7 to translate to and fro, while the articulation constituted of the horizontal guideway 16 and of the roller 17 ensures the possibility of sliding motion of the slide 17 itself with respect to the slide 19; the second motion in a direction orthogonal with respect to the direction of advancement A of the chains is controlled by the second not-shown electromagnet that, by means of the slide 19 articulated with the slide 7, causes the lowering or lifting of the sharpened pins 10 with respect to the guideway 4 for the chains.

The two electromagnets controlling the reciprocating motions as above are actuated in a synchronized manner by means of electric pulses applied according to a predetermined time sequence. Firstly the sharpened pins 10 are lowered for their engagement with the respective side by side links of the underlying chains at the exit end of the guideway 4, then the whole group 6 with the sharpened pins 10 engaged with the respective links is made to advance in the direction A for a space corresponding to the length of chain that has to be fed; then the pins 7 are lifted for disengaging them from the links and then the return motion of the same is commanded in the direction A for bringing them back in the starting position. These motions are intermittent and occur according to a time sequence that is a function of the operations to be performed downstream of the device itself. The amplitude of the respective sliding motions of the plungers 21 and 24 of the two electromagnets are suitably adjusted according to the needs by means of respective adjustment screws 27 (FIG. 2) and 28 (FIG. 1).

The passage through one or more operative units located downstream of the feeding device above described whatever their kind is, has to occur in such a manner so that the chain is constantly under adequate tensile stress. To this end, downstream of the operative units, a pulling device should be provided operating synchronously with the above described transport means of the chains, in particular associated to the take-up coil of the chain itself. This device even if it is necessary for the correct operation of the feeding device according to the present invention, will not be described or illustrated into detail because the same is substantially of a known nature and outside the scope of protection of the invention itself.

The guideway 4 of the chains and the head 9 carries sharpened pins that can be easily changed for adapting the device to various production needs, for instance for feeding a different number of chains or for feeding chains having different dimensions.

It is clear moreover that in order to provide the above described double reciprocating motion to the transport means 6 of the chains, different means may be utilized anyhow equivalent to the end of the obtained result. In particular, advancement system different from the illustrated ones may be utilized: for instance in place of the electromagnets alternative actuators might be used, of the electromechanic, hydraulic or pneumatic kind. In the present embodiment the actuation by means of electromagnets has been preferred only on the grounds of convenience, because of the easier availability of electric power with respect to other forms of energy, such as compressed air, and for the greater constructive and operative simplicity with respect to hydraulic actuator systems.

It is to be remarked finally that, even if the device according to the present invention has been described substantially in connection with its use in machinery for the production of paired ornamental chains, clearly its utilization should not be considered as being limited to this application, but it is extended to all the further applications that may show similar needs.

Changes and/or modifications may be introduced in the device for the parallel automatic feed of ornamental chains, in particular for the production of paired chains, as above described and illustrated, without departing from the scope of protection of the invention itself.

What is claimed is:

1. A device for the parallel feeding of at least two ornamental chains to a work station of an apparatus so that work may be performed simultaneously on the combination of said chains, said feeding device comprising:

a chain supply station;

a chain alignment station disposed downstream of said chain supply station in the direction of feeding of said chains; and a chain transport station disposed downstream of said chain alignment station in the direction of feeding of said chains;

said chain supply station including means for supplying said chains to said chain alignment station in said feeding direction, said chain alignment station including a single means for aligning said chains, received from said supplying means, in side-by-side disposition, and a first guideway for supporting said aligned chains as they move in said feeding direction toward said transport station, and said transport station including means for engaging side-by-side links of said aligned chains, said engaging means including a link-engaging portion and a support portion extending in a direction normal to said feeding direction, said engaging means support portion having, at an end removed from said link-engaging portion, a sleeve member having a horizontally extending guideway, first means for moving said engaging means in reciprocating forwardly and rearwardly directed motions in directions parallel with said feeding direction, and second means, disposed at a forward region of said first guideway, for moving said engaging means in reciprocating lifting and lowering motions in said direction normal to said feeding direction, said second moving means lifting said engaging means at the end of the forwardly directed motion of said engaging means so that the engaging means link-engaging portion will become disengaged from the links after the advancement of a predetermined length of said chains, and said second moving means lowering said engaging means at the end of the rearwardly directed motion of said engaging means so that the engaging means link-engaging portion can be moved into engagement with a new set of links disposed side-by-side, said first means for moving said engaging means in said reciprocating motions comprising first actuating means for causing said two reciprocating motions, first linkage means connected with said first actuating means and drivable by said first actuating means in said two reciprocating motions, said first linkage means including a sleeve member having a vertically extending guideway in which said engaging means support portion is slidably supported and through which said engaging means support portion extends, said second means for moving said engaging means in said reciprocating lifting and lowering motions comprising second actuating means for causing said lifting and lowering motions, second linkage means connected at one end thereof with said second actuating means and being drivable by said second actuating means in said lifting and lowering motions, said second linkage means including a roller at an end thereof opposite said one end, said roller being constrained for horizontal movement in said horizontally extending guideway of said engaging means support portion, whereby movements of said first means for moving said engaging means, interconnected with said second means for moving said engaging means by said roller of said second linkage means and said horizontally extending guideway of said engaging means support portion, do not interfere with movements of said second means for moving said engaging means, and vice versa, so that said link-engaging portion of said engaging means.

2. A device according to claim 1, wherein said engaging means for the chains comprises a head carrying needle-shaped members in a number equal to the number of the chains to be advanced, said head being disposed orthogonal to the first direction and facilitating the engagement of each one of said needle-shaped members in a corresponding link of the chain lying beneath said head.

3. A device according to claim 2, wherein said needle-shaped members comprise parallel sharpened pins lying in a plane orthogonal to the first direction.

4. A device according to claim 2, wherein said head carrying said sharpened pins is integral with a first vertical slide slidingly mounted within a corresponding movable guideway slidable in a horizontal sense.

5. A device according to claim 1, wherein said first and second actuating means for said reciprocating motions are constituted of electromagnetic devices.

6. A device according to claim 2, wherein said head carrying said needle-shaped members is adjustable with respect to said engaging means support portion and is replaceable.

7. A device according to claim 1, wherein said single aligning means for the chains is replaceable.

* * * * *